United States Patent [19]

Munk et al.

[11] Patent Number: 4,977,930

[45] Date of Patent: Dec. 18, 1990

[54] PLUG FOR WRAPPED SLEEVES OF PAPER OR CARDBOARD

[75] Inventors: Edmund Munk, Oberstenfeld; Helmuth Huber, Gronau, both of Fed. Rep. of Germany

[73] Assignee: Werzalit AG & Co., Stuttgart, Fed. Rep. of Germany

[21] Appl. No.: 173,155

[22] Filed: Mar. 24, 1988

[30] Foreign Application Priority Data

Oct. 31, 1987 [EP] European Pat. Off. ..... 87116059.4

[51] Int. Cl.[5] ..... F16L 11/12; B65H 75/18

[52] U.S. Cl. ..... 138/89; 138/44; 138/96 R; 138/109; 138/110; 138/178; 242/68.6; 206/413; 206/416

[58] Field of Search ..... 138/96 R, 96 T, 110, 138/109, 178, 89, 44; 242/68.6; 16/2, 108, 109; 229/93; 206/413, 414, 415, 416

[56] References Cited

U.S. PATENT DOCUMENTS

| | | | |
|---|---|---|---|
| 3,547,367 | 12/1970 | Brazeole et al. | 242/68.6 |
| 3,567,146 | 3/1971 | Arenson | 242/68.6 |
| 3,627,220 | 12/1971 | Vogel | 242/68.6 |
| 3,840,194 | 10/1974 | Vetter | 242/68.6 |
| 3,865,326 | 2/1975 | Beaudoin | 242/68.6 |
| 4,279,275 | 7/1981 | Stanwood et al. | 138/109 |
| 4,372,500 | 2/1983 | Saraisky | 242/68.6 |

FOREIGN PATENT DOCUMENTS

| | | | |
|---|---|---|---|
| 586556 | 11/1959 | Canada | 242/68.6 |

*Primary Examiner*—James E. Bryant, III
*Attorney, Agent, or Firm*—Michael J. Striker

[57] ABSTRACT

A plug for plugging wrapped sleeves of paper or cardboard includes a hollow rotation-symmetrical body one half of which is cylindrical and another part of which is frusto-conical. The outer edge or rim of the cylindrical part is provided with a thickening which continually increases towards the end face of the plug.

4 Claims, 1 Drawing Sheet

PLUG FOR WRAPPED SLEEVES OF PAPER OR CARDBOARD

BACKGROUND OF THE INVENTION

The present invention relates to a one-piece compression-molded, substantially cylindrical plug for plugging a sleeve wrapped up of paper or cardboard.

Plugs of the type under discussion are substantially cylindrical hollow elements pressed or molded of the mixture of fibers with a heat-hardenable binder and utilized for wrapped sleeves of paper or cardboard. Such a plug is cylindrical over the half of its length and has a substantially the same outer diameter over that half while its other half or remaining portion is conical. Thickenings are provided on the peripheral face of the plug.

Such a plug has been disclosed, for example, in "Compression molded plug for rolled sleeves," Fa. Werzalit AG & Co., Unternehmenbereich Industrieproducte, 7141 Oberstenfeld.

Known plugs of the foregoing type are utilized with rolled sleeves which are preferably made of paper, cardboard and/or paperboard according to German standard No. DIN6748. After the wrapping material is wrapped about the sleeve the wrapped up roll is removed from the wrapping device and the plug is driven into such roll before the latter is transported to a packing device.

End faces of such rolls or sleeves wrapped with wrapping material are covered firstly with circular discs or washers, for example of paperboard by a packing device, and then the periphery of the roll of wrapping material is wound up with paper in the packing machine. The circular discs or washers are secured to the plugs by means of clamps.

When tolerances of the external diameter of the plug and/or internal diameter of the wrapped-up sleeve are added to negative values it can occur that the plug, during fastening of the circular disc by a required large driving force for the clamps, is driven into the sleeve over a predetermined length.

This, however, causes a disadvantageous effect which resides in that the disc does not snugly abut the end face of the wrapped up sleeve but the disc becomes at its outer edge concavely deformed. This leads to the fact that the deformed edge of the disc is not detected in the packing device in which wrapping up of the rolls is carried out automatically, and the packing can be incorrect.

SUMMARY OF THE INVENTION

It is an object of the present invention to provide an improved plug for plugging sleeves to be wrapped up of paper or cardboard.

It is another object of this invention to provide a plug the unlimited insertion of which into the sleeve during the fastening of the disc to the sleeve be prevented.

These and other objects of the invention are attained by a one-piece plug formed of a mixture of fibrous material and a heat-hardenable binder and used for sleeves wrapped of paper or cardboard, comprising a substantially rotation-symmetrical hollow body including a cylindrical part which extends over approximately a half of a length of said body and has a constant external diameter, and a remaining frusto-conical part, said body having a peripheral surface provided with thickenings extending along an axis of said body and spaced from each other on a circumference of said body, said body having an outer edge at said cylindrical part, said outer edge portion starting at a point of approximately 90% of the entire length of said body and having a thickening continually increasing towards an end face of said body.

Due to the provision of the thickening at the outer edge or rim of the plug it is ensured, on the one hand, that the plug be driven into the wrapped sleeve so far that its outer surface would not project over the end face of the wrapping material and the sleeve would not be deformed, and, on the other hand, a further driving of the plug into the sleeve during fastening of the cover disc thereto would be reliably prevented.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is an end view of the plug of FIG. 1.

DETAILED DESCRIPTION OF THE PREFERRED EMBODIMENTS

Figure 1:
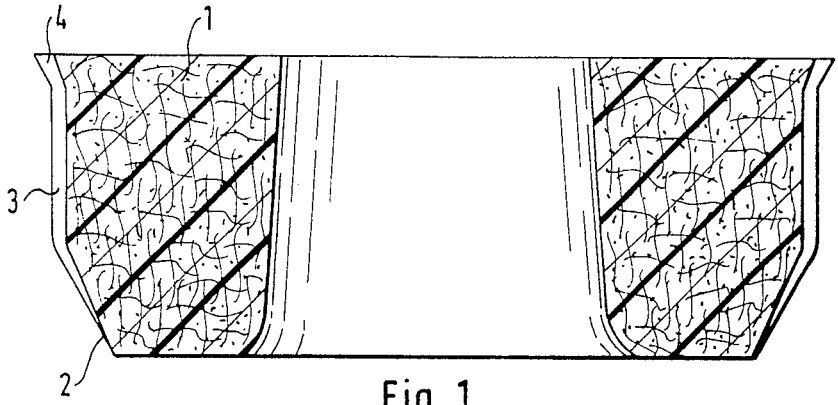
FIG. 1 is an axial sectional view of the plug for a rolled sleeve, according to the invention.

Referring now to the drawings in detail, and firstly to FIG. 1 thereof, it will be seen that a plug or bung according to the present invention is formed of a rotation-symmetrical hollow cylindrical body 1 which at least over a half of its length has a constant outer diameter. This substantially cylindrical portion merges into a frustoconical portion 2 which facilitates the insertion of the plug into the rolled sleeve or roller. Thickenings 3 are positioned on the upper surface of the plug, which thickenings are provided for a tolerance compensation and to increase friction between the plug and the wrapped sleeve. The plug shown in FIG. 1 has, for example four thickenings uniformly spaced from each other on the periphery of the plug. At the external end of the plug edge the outer diameter of the plug is continually increased. This small thickening 4 produced without substantial expenses generates a required resistance to counteract to the driving-in force of the plug.

Figure 2:
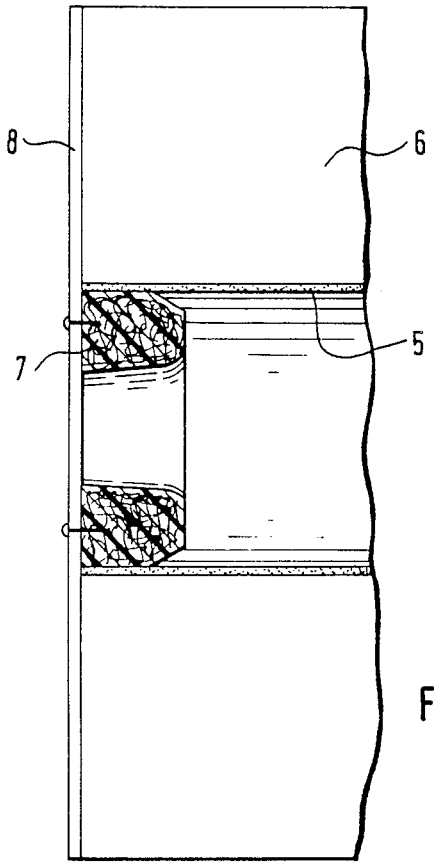
FIG. 2 is a partial view of the rolled material cylinder which includes the plug of FIG. 1.

The insertion of the plug shown in FIG. 1 into the sleeve 5 is clearly shown in FIG. 2. The sleeve 5 is wrapped with a wrapper material 6, for example a great number of paper turns. The plug 1 is driven into the sleeve 5 at the insertion end of which a disc 8 is positioned, which is connected to sleeve 5 by means of clamps or clips.

The non-ascended mixture from which the plug must be made is consisted mainly of a ligno-cellulose fiber material such as chopped and dried wood chips, bagasse fibers and the like, which is mixed with a heat-hardenable material, such as a melamin-urea formaldehyde- or phenol formaldehyde. In place of comminuted and dried-up wood or bagasse fibers, also fibers of other materials, such as glass fibers, steel wool or asbestos, can be used alone or in some combinations and mixed with a suitable, preferably organic binder.

It will be understood that each of the elements described above, or two or more together, may also find a useful application in other types of plugs for sleeves wrapped up of paper differing from the types described above.

While the invention has been illustrated and described as embodied in a plug for a sleeve wrapped up of paper or cardboard, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A one-piece plug formed of a mixture of fibrous material and a heat-hardenable binder and used for sleeves wrapped of paper or cardboard, comprising a substantially rotation-symmetrical hollow body including a cylindrical part which extends over approximately half of a length of said body and has a constant external diameter, and a remaining frustoconical part, said body having a peripheral surface provided with axial thickenings extending along an axis of said body and spaced from each other on a circumference of said body, said body having an outer edge portion at said cylindrical part, said outer edge portion starting at a point of approximately 90% of the entire length of said body and having an annular thickening continually increasing towards an end face of said body, said axial thickenings extending over said frustoconical part, said cylindrical part and said annular thickening.

2. A plug as defined in claim 1, wherein said thickening at said outer edge is frustoconical.

3. A one-piece plug formed of a mixture of fibrous material and a heat-hardenable binder and used for sleeves wrapped of paper or cardboard, comprising a substantially rotation-symmetrical hollow body including a cylindrical part which extends over approximately half of a length of said body and has a constant external diameter, and a remaining frustoconical part, said body having a peripheral surface provided with axial thickenings extending along an axis of said body and spaced from each other on a circumference of said body, said body having an outer edge portion at said cylindrical part, said outer edge portion starting at a point of approximately 90% of the entire length of said body and having an annular thickening continually increasing towards an end face of said body, said body having an opposite end face, and said axial thickenings extending from said opposite end face over said frustoconical part, and having a radial thickness which increases from said opposite end face over said frustoconical part in direction toward said first-mentioned end face.

4. A plug as defined in claim 3, wherein said axial thickenings have a constant radial thickness in the region of said cylindrical part of said hollow body.

* * * * *